US010870960B2

(12) United States Patent
Kautzman

(10) Patent No.: US 10,870,960 B2
(45) Date of Patent: Dec. 22, 2020

(54) SNOW AND DEBRIS REMOVAL APPARATUS

(71) Applicant: Todd E. Kautzman, Mott, ND (US)

(72) Inventor: Todd E. Kautzman, Mott, ND (US)

( * ) Notice: Subject to any disclaimer, the term of this patent is extended or adjusted under 35 U.S.C. 154(b) by 0 days.

(21) Appl. No.: 15/906,707

(22) Filed: Feb. 27, 2018

(65) Prior Publication Data

US 2018/0245299 A1 Aug. 30, 2018

Related U.S. Application Data

(60) Provisional application No. 62/464,642, filed on Feb. 28, 2017.

(51) Int. Cl.

| | |
|---|---|
| ***E01H 5/10*** | (2006.01) |
| ***E01H 1/08*** | (2006.01) |
| *E01H 5/04* | (2006.01) |

(52) U.S. Cl.

CPC ..... *E01H 5/106* (2013.01); *E01H 1/0809* (2013.01); *E01H 5/04* (2013.01)

(58) Field of Classification Search

CPC ..... E01H 5/106; E01H 5/04; E01H 1/0809; E01H 2001/089

See application file for complete search history.

(56) References Cited

U.S. PATENT DOCUMENTS 3,117,685 A * 1/1964 Davis ..... E02F 3/386 414/695
3,156,488 A * 11/1964 Kelly ..... E02F 3/386 280/456.1
3,215,282 A * 11/1965 Wiemann ..... B62D 49/065 280/765.1
3,436,099 A * 4/1969 Long ..... E02F 3/386 280/456.1
3,534,725 A * 10/1970 Davis, Sr. ..... A01M 15/00 126/271.2 A
3,993,206 A * 11/1976 Jomen ..... E02F 3/386 414/695
4,553,284 A * 11/1985 Strumbos ..... A47L 9/02 15/414
4,858,270 A * 8/1989 Boschung ..... E01H 1/0818 15/328

(Continued)

OTHER PUBLICATIONS

"Aerospace Polymer Nozzle—Part # 2851", (Accessed Feb. 2017), 1 pg.

(Continued)

*Primary Examiner* — Jamie L McGowan

(74) *Attorney, Agent, or Firm* — Schwegman Lundberg & Woessner, P.A.

(57) ABSTRACT

A debris removal apparatus (e.g., for moving snow) can include a frame configured to attach to a prime mover. The frame can include one or more rails that extend from a first side of the frame to a second side of the frame. Additionally, the debris removal apparatus can include a carriage configured to translate along the one or more rails of the frame. Further, the debris removal apparatus can include a blower configured to intake a fluid and discharge the fluid at a blower outlet. The blower can be coupled with the carriage. Still further, the debris removal apparatus can include a nozzle configured to couple with the blower outlet.

14 Claims, 7 Drawing Sheets

(56) References Cited

U.S. PATENT DOCUMENTS 4,878,713 A * 11/1989 Zanetis ..... E01C 23/088 299/39.5
4,921,392 A * 5/1990 Wagner ..... E02F 3/386 212/304
4,941,786 A * 7/1990 Steinbock ..... E02F 3/386 172/667
5,054,159 A * 10/1991 Richardson ..... A47L 5/14 15/400
5,203,615 A * 4/1993 Zanetis ..... E01C 23/088 299/39.5
5,606,809 A * 3/1997 Allen ..... E02F 3/386 37/443
7,814,615 B1 * 10/2010 Ries ..... A01D 7/10 15/405
9,949,462 B2 * 4/2018 Zimmerman ..... A01K 31/04
10,094,083 B2 * 10/2018 Wuillemin ..... E01H 5/098
D834,271 S * 11/2018 Naslund ..... D32/15
2007/0199175 A1 * 8/2007 Syracuse ..... E01H 1/0809 15/405
2008/0023206 A1 * 1/2008 Rossi ..... E02F 3/386 172/273
2009/0166444 A1 * 7/2009 Peterson ..... F04D 29/601 239/13
2012/0144998 A1 * 6/2012 Burgo ..... E02F 3/386 92/161
2012/0255585 A1 * 10/2012 Kowalczyk ..... F26B 19/005 134/37
2014/0075705 A1 * 3/2014 Ross ..... E01H 1/0818 15/246

OTHER PUBLICATIONS

"Hydraulic Snow Blower", Buffalo Turbine, (Accessed Feb. 2017), 2 pgs.

* cited by examiner

SNOW AND DEBRIS REMOVAL APPARATUS

PRIORITY APPLICATION

This application claims priority to U.S. Provisional Application Ser. No. 62/464,642, filed Feb. 28, 2017, the disclosure of which is incorporated herein in its entirety by reference.

OVERVIEW

A debris blowing apparatus adapted to move debris that is located on a surface is disclosed herein. In an example, such debris may include snow, rocks, sand, dirt, rubbish, water, grain, or wood chips. In a particular example, the configuration of the debris blowing apparatus discussed herein is applicable for use as a snowblower, to allow the displacement and movement of snow from surfaces such as sidewalks, streets, parking lots, platforms, buildings, and like objects.

In an example, a debris removal apparatus can include a frame configured to attach to a prime mover (e.g., a skid-steer loader). The frame can include one or more rails that extend from a first side of the frame to a second side of the frame. Additionally, the debris removal apparatus can include a carriage configured to translate along the one or more rails of the frame. Further, the debris removal apparatus can include a blower configured to intake a fluid and discharge the fluid at a blower outlet. The blower can be coupled with the carriage. Still further, the debris removal apparatus can include a nozzle configured to couple with the blower outlet.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
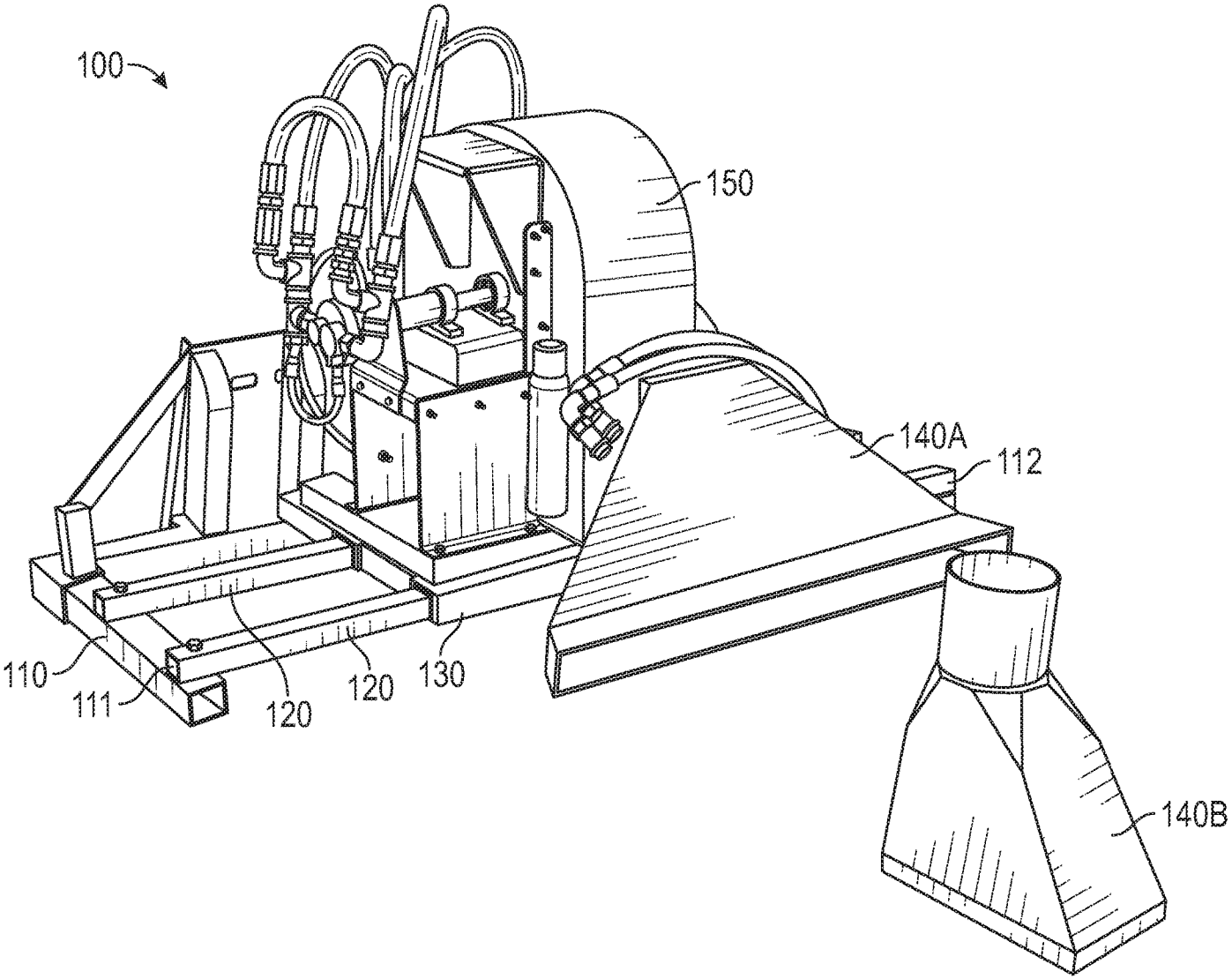
FIG. 1 is a perspective view of an example of a debris removal apparatus.

FIG. 1 is a perspective view of an example of a debris removal apparatus 100. In an example, the debris removal apparatus 100 is a debris blowing apparatus. In an example, the debris removal apparatus 100 includes a frame 110, one or more rails 120, a carriage 130, a first nozzle 140A, a second nozzle 140B, and a blower 150. As will be discussed herein, the frame 110 can be configured to attach to a prime mover (e.g., a skid loader, a skid steer, a tractor, a front end loader, a truck, a telehandler, an all-terrain-vehicle, a side-by-side, a utility vehicle, a forklift, a commercial mower, or the like) (not shown in FIG. 1). The frame 110 can include one or more rails 120. The one or more rails 120 can be coupled with the frame 110. The one or more rails 120 can extend from a first side 111 of the frame 110 to a second side 112 of the frame 110. The one or more rails 120 can have a circular, square, or other polygonal cross section. The one or more rails 120 can include a channel that extends along a longitudinal axis of the one or more rails 120. In an example, a plurality of guide rails is used and the plurality of guide rails are spaced apart at a first distance.

The frame 110 can include a cutting edge configured to be in communication with, and translate across, a surface. The cutting edge can partially or entirely remove, displace, or dislodge debris in front of (e.g., the side that the nozzle 140A is coupled to) the debris removal apparatus 100. In an example, a cutting edge is a wheel that extends from the frame 110. The cutting wheel can be configured from steel or other rigid material. The cutting wheel can have an edge. The cutting wheel can be coupled to an arm. The arm can be coupled to the frame 110. The cutting wheel can extend in front of the first nozzle 140A. The cutting wheel can be used to loosen debris ahead of the debris removal apparatus 100. In an example, the cutting wheel (or other type of cutting edge) is placed into contact with a driveway (e.g., a blowing surface) that has hard-packed snow attached (e.g., stuck, stubbornly attached, or otherwise difficult to separate) to a driveway or sidewalk. A downward force can applied to the cutting wheel and the cutting wheel can break through the hard-packed snow. Breaking up the hard-packed snow (or other stubborn debris) in front of the debris removal apparatus 100 can improve the ability for the debris removal apparatus 100 to remove the snow from the driveway or sidewalk.

In an example, the debris removal apparatus 100 includes a carriage 130. The carriage 130 can be configured to translate along the one or more rails 120 of the frame 110. The carriage 130 can include a number of sliders. The sliders can mate with the one or more guide rails such that the carriage 130 is able to translate along the one or more rails 120. In an example, the sliders of the carriage 130 have substantially the same cross section as the one or more rails 120. However the dimensions of the sliders can be greater than the dimensions of the one or more guide rails. In an example, the one or more rails 120 have a square cross section. The sliders of the carriage 130 also have a square cross section. However, the dimensions of one or more rails 120 are less than the sliders of the carriage 130. The sliders can be mated with the one or more rails 120 and will be able to translate along (e.g., slide over or with respect to) the one or more rails 120. In an example, the one or more rails 120 include a channel or a keyway. The carriage 130 can include a key to mate with the keyway and the mating of the key with the keyway can allow the key to translate (e.g., slide) within the keyway. In an example, the carriage 130 includes one or more bearings to assist the translation of (e.g., rolling of) the carriage 130 along the one or more rails 120.

In an example, the debris removal apparatus 100 includes a blower 150. The blower 150 can intake a fluid (e.g., air) and discharge the fluid at a blower outlet (not shown). In an example, the blower intakes (e.g., sucks in) air at a blower intake and discharges (e.g., blows out) the air at the blower outlet (e.g., the blower outlet 355 shown in FIG. 3). The air discharged at the blower outlet will exit the blower at a first velocity. The blower can also use other fluids (e.g., water or a saline solution). The blower outlet has blower outlet dimensions (e.g., a width $X_1$ and a height $Y_1$). The blower dimensions give the blower outlet a blower outlet area (e.g., $X_1$ multiplied by $Y_1$)

In an example, the blower outlet is configured to mate with one or more nozzles (e.g., a nozzle 140A or a nozzle 140B). In an example the first nozzle 140A is coupled to the blower outlet. The first nozzle 140A has first nozzle dimensions (e.g., a width $X_2$ and a height $Y_2$). The first nozzle dimensions give the first end of the nozzle a first nozzle area (e.g., $X_2$ multiplied by $Y_2$). The blower outlet dimensions and the first nozzle dimensions can be equal (e.g., $X_1=X_2$ and $Y_1=Y_2$). The blower outlet dimensions and the first nozzle dimensions can vary slightly (e.g., $X_2=X_1+c$ and $Y_2=Y_1+c$) such that the blower 150 is received by (e.g., configured to mate with) the nozzle 140A. The blower outlet dimensions and the first nozzle dimensions can vary slightly (e.g., $X_2=X_1-c$ and $Y_2=Y_1-c$) such that the nozzle 140A (or the nozzle 140B) is received by (e.g., configured to mate with) the blower 150.

Figure 2:
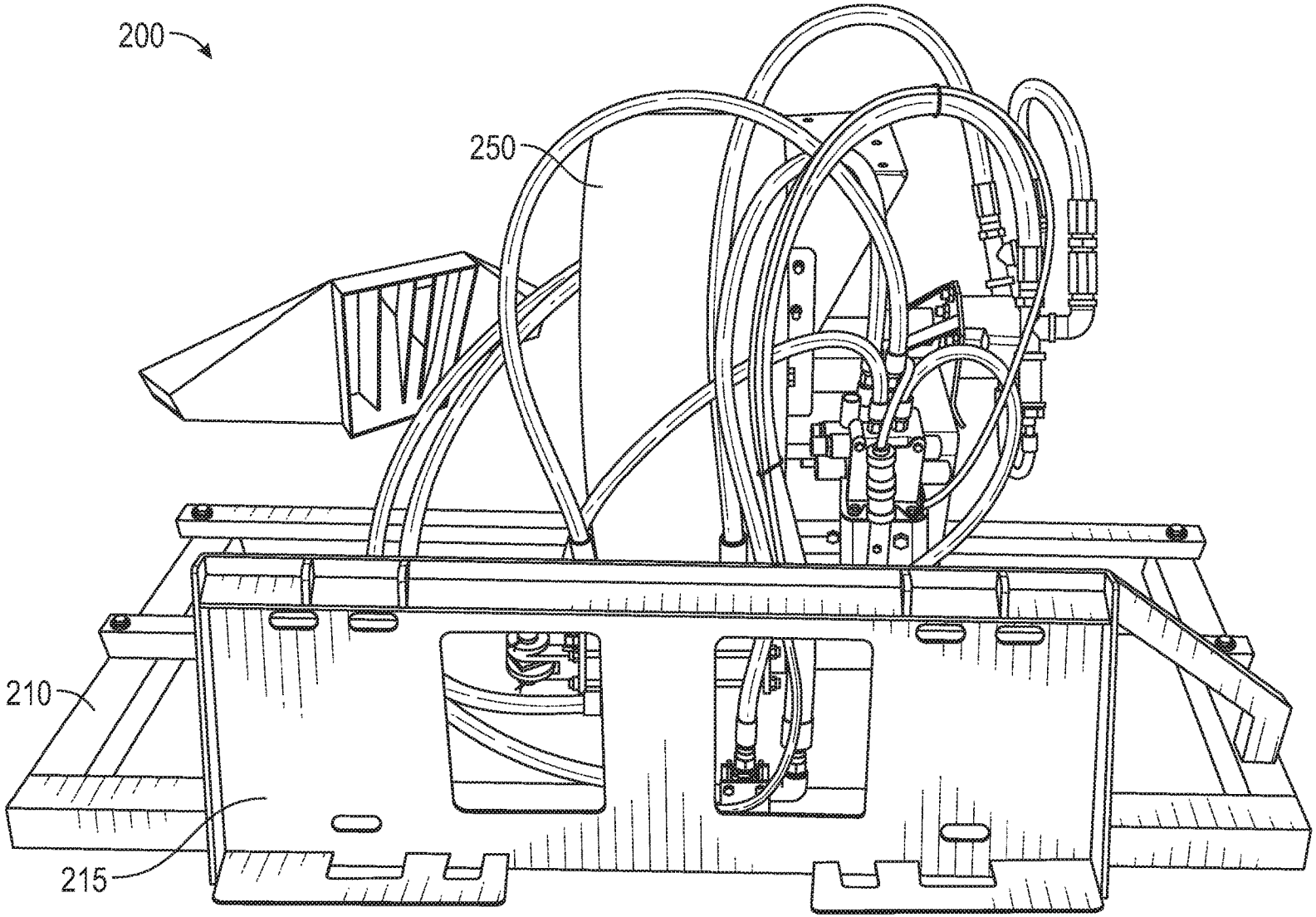
FIG. 2 is a rear view of an example of a debris removal apparatus.

FIG. 2 is a rear view of an example of a debris removal apparatus 200. In an example, the debris removal apparatus 200 includes a frame 210, an attachment member 215, and a blower 250. In an example, the attachment member 215 is coupled with the frame 210. The attachment member 215 can allow for the frame 210 to be coupled with a prime mover (not shown). The attachment member 215 can be a universal mounting plate for attaching to the prime mover. The attachment member 215 can include features (e.g., slots and grooves) that interlock with features of the prime mover. The prime mover can receive the attachment member 215 and thereby couple with the frame 210. In an example, the prime mover may provide hydraulic and electric control for positioning of the blower 250 upon the apparatus 200, as discussed in the examples below.

Figure 3:
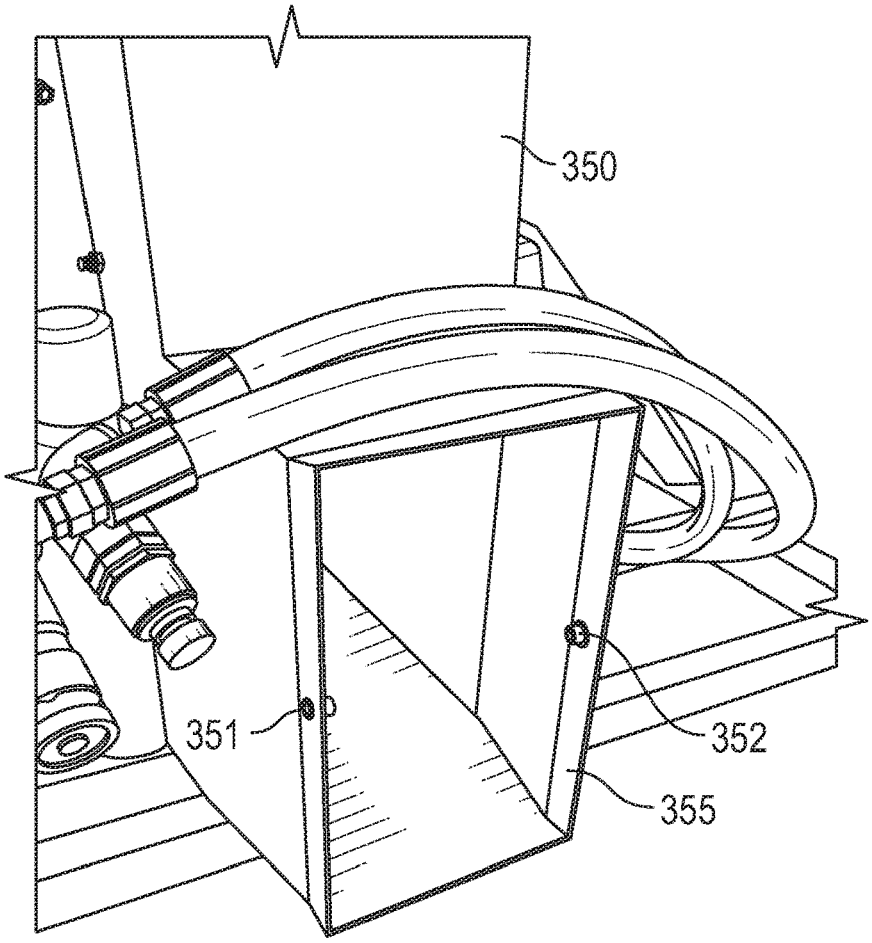
FIG. 3 is a perspective view of an example of a blower with a blower outlet.

FIG. 3 is a perspective view of an example of a blower 350 with a blower outlet 355. In an example, the blower 350 includes the blower outlet 355 and attachment points 351 and 352. The blower 350 can intake a fluid (e.g., air) and discharge the fluid from the blower outlet 355 at a first velocity. The blower 350 can be configured to discharge the fluid from the blower outlet 355 at a plurality of velocities. In some examples, the blower outlet 355 includes a gasket configured to mate with a nozzle (e.g., the first and second nozzles 140A and 140B of FIG. 1) and prevent (e.g., substantially inhibit) a fluid (e.g., air or water) from passing between the blower 350 and the nozzle.

In an example, the attachment points 351 and 352 are used to couple a nozzle (e.g., the first and second nozzles 140A and 140B of FIG. 1) to the blower 350. The attachment points 351 and 352 can be included in a plurality of attachment features that couple the nozzle with the blower 350. The attachment points can be threaded to receive a corresponding threaded fastener and thereby couple the nozzle with the blower 350. The attachment points 351 and 352 can include a smooth bore and receive a fastener (e.g., a clevis pin or cotter pin) and thereby couple the nozzle with the blower 350. A fastener can be coupled to each of the attachment points 351 and 352 and thereby couple the nozzle with the blower 350. A single fastener (e.g., a long pin or bolt) can be inserted into the attachment points 351 and 352 and extend therebetween, and thereby couple the nozzle with the blower 350. The attachment points 351 and 352 can mate with corresponding features on the nozzle. In an example, the nozzle includes hooks that correspond in location to the attachment points 351 and 352 and can hook onto the attachment points 351 and 352, thereby coupling the nozzle with the blower 350. Although attachment points 351 and 352 are described herein, other combinations and numbers of attachment points can be used. In an example, the blower 350 only includes the attachment point 351 or the attachment point 352. In another example, the attachment points 351 and 352 are included in a plurality of attachment points. Other attachment mechanisms can be used to couple the nozzle with the blower 350.

Figure 4:
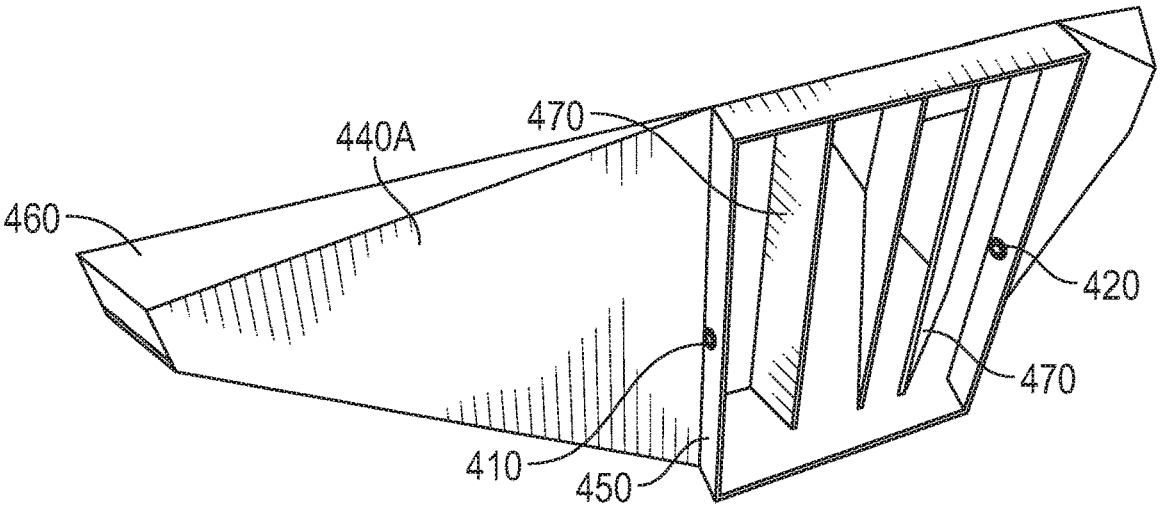
FIG. 4 is a perspective view of a first nozzle.

FIG. 4 is a perspective view of a first nozzle 440A. In an example, the nozzle 440A includes one or more attachment features 410 and 420, a first nozzle end 450, a second nozzle end 460, and one or more internal structures 470. In an example, the one or more attachment features 410 and 420 are used to couple the first nozzle 440A to a blower (e.g., the blower 350 of FIG. 3). The one or more attachment features 410 and 420 can be through holes in the first nozzle 440A that are configured to allow a fastener to pass through the first nozzle 440A. A fastener can be placed into (or through) the attachment features 410 and 420 and coupled with attachment points of a blower (e.g., the attachment points 351 and 352 of FIG. 3). The attachment features 410 and 420 can be concentrically aligned with the attachment points. In an example, the attachment features 410 and 420 are hooks that correspond in location to the attachment points and can hook onto the attachment points, thereby coupling the first nozzle 440A with the blower. In an example, the attachment features 410 and 420 are components of a latching system. The attachment features 410 and 420 can each be one half of a latching system and configured to couple with corresponding latching features (e.g., the attachment points 351 and 352 of FIG. 3) on the blower. In an example, the first nozzle 440A only includes the attachment feature 410 or the attachment feature 420. In an example, the attachment features 410 and 420 are included in a plurality of attachment features.

In an example, the first end 450 of the first nozzle 440A is configured to mate with a blower output (e.g., the blower outlet 355 of FIG. 3). As the blower exhausts a fluid (e.g., air or water) from the blower output, the fluid enters the first end 450 of the first nozzle 440A. As the fluid travels through the nozzle, the fluid can interact, or communicate, with one or more internal structures 470 before the fluid is exhausted from the second end 460 of the first nozzle 440A. The internal structures 470 can alter the flow of the fluid within the first nozzle 440A. In an example, the internal structures 470 can disperse the flow of the fluid within the first nozzle 440A such that the fluid is exhausted uniformly (e.g., at a substantially similar pressure and velocity) from the second end 460 of the first nozzle 440A. The one or more internal structures 470 can be configured to increase the velocity of the fluid within the first nozzle 440A. The one or more internal structures 470 can be configured to decrease the velocity of the fluid within the first nozzle 440A.

The first nozzle 440A can be configured to increase the velocity of the fluid from the first end 450 to the second end 460. The first nozzle 440A can be configured to decrease the velocity of the fluid from the first end 450 to the second end 460. The first end 450 can have a first nozzle area. The second end 360 can have a second nozzle area. The first and second nozzle areas are the areas of the apertures at the first end 450 and the second end 460, respectively. The second nozzle area can be less than the first nozzle area. The second nozzle area can be greater than the first nozzle area. The velocity of the fluid within the first nozzle 440A will decrease if the second area is greater than the first area. The velocity of the fluid within the first nozzle 440A will increase if the second area is less than the first area.

The preceding discussion of the first nozzle 440A is similarly applicable to other nozzles (e.g., the second nozzle 140B of FIG. 1) that are configured to mate with a blower (e.g., the blower 350 of FIG. 3).

Figure 5:
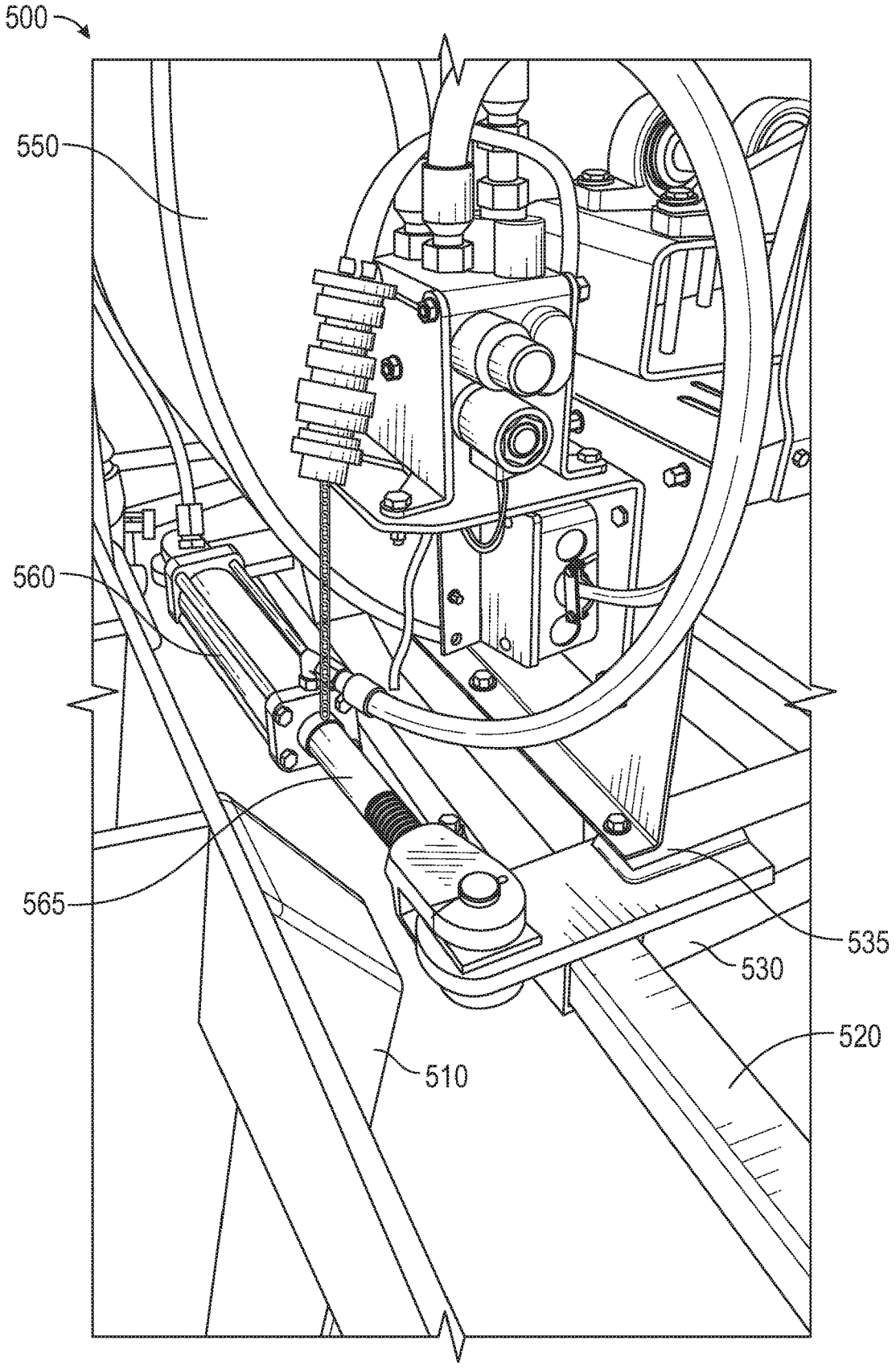
FIG. 5 is a perspective view of a debris removal apparatus including an actuator.

FIG. 5 is a perspective view of a debris removal apparatus 500 including an actuator 560. In an example, the debris removal apparatus 500 includes one or more rails 520, a carriage 530, a blower 550, and the actuator 560. The actuator 560 can be operated by electrical, mechanical, pneumatic, or hydraulic power systems, including such systems provided by a prime mover. In an example, the actuator 560 is configured to assist the translation of the carriage along the one or more rails 520. In an example, the actuator 560 is a hydraulic cylinder that is configured to linearly extend and retract a rod 565. The actuator 560 can have one end coupled (e.g., affixed) to the frame 510 and an opposing end coupled to the carriage 530. The actuator 560 can have one end coupled to the one or more rails 520 and an opposing end coupled to the carriage 530. The extension and retraction of the rod 565 can translate the carriage 530 with respect to the one or more rails 520 (or the frame 510). The actuator 560 can be repositionable along the frame 510 or the one or more rails 520. The actuator 560 can be repositionable to allow for a smaller actuator 560 to be used with the debris removal apparatus 500. Using a smaller actuator can decrease the overall cost of the debris removal apparatus 500 without significantly affecting performance of the debris removal apparatus 500.

In an example, the actuator 560 is a motor including a first drive wheel and the motor is coupled to the frame 510 or the one or more rails 520. The carriage 530 can include a second drive wheel. The first and second drive wheels can be sprockets. A tensile member (e.g., a chain, a belt, a rope, or the like) can transmit the rotational force applied to the first drive wheel to the second drive wheel. Operating the motor and driving the first drive wheel will turn the second drive wheel and can thereby translate the carriage 530 along the one or more rails 520. Other power transmission techniques, such as gear sets (e.g., a wormset) or a rack and pinion, can be used to assist the translation of the carriage 530 along the one or more rails 520.

Figure 6:
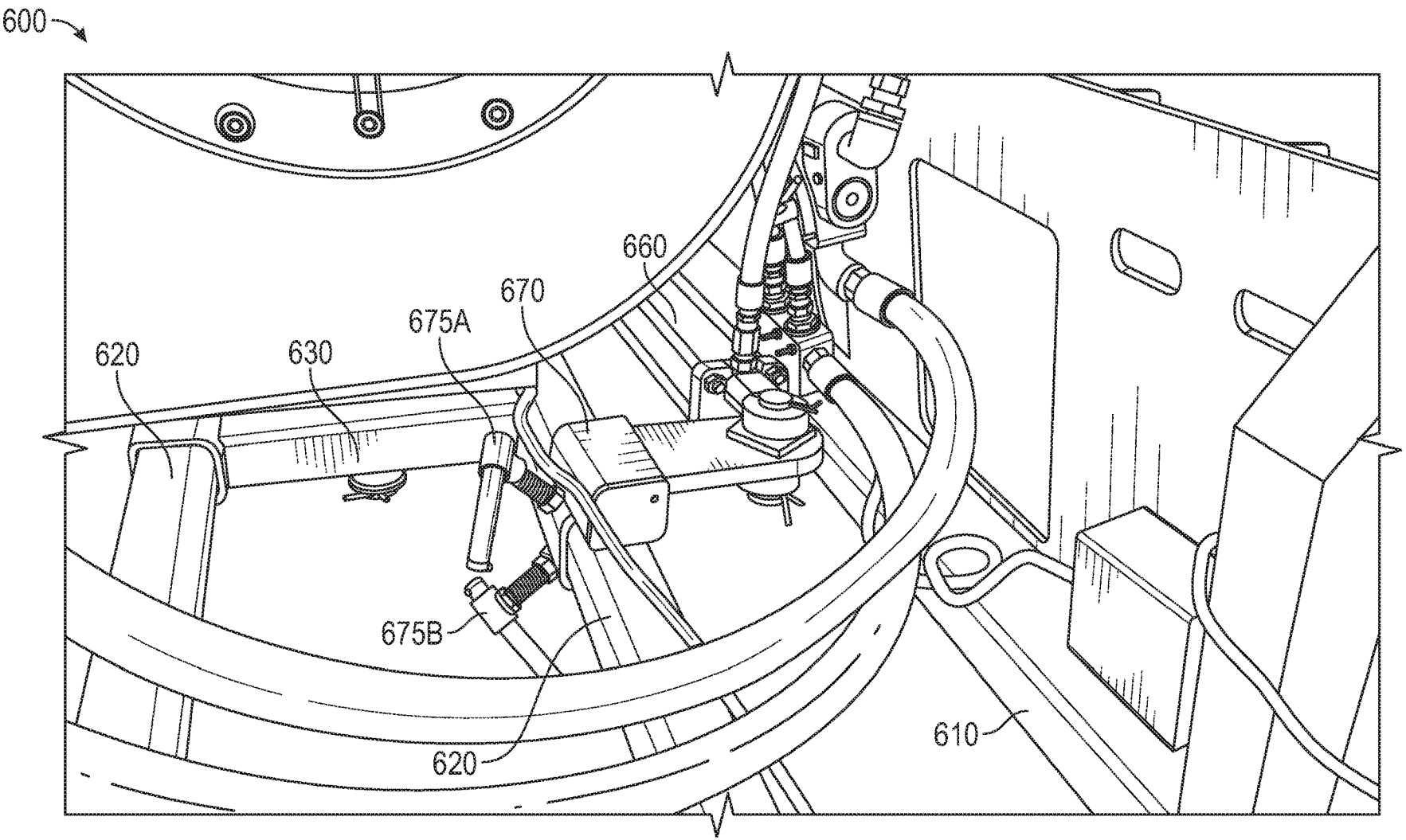
FIG. 6 is another perspective view of a debris removal apparatus including an actuator.

FIG. 6 is a perspective view of a debris removal apparatus 600 including an actuator 660. As previously discussed, the actuator 660 can be repositioned along the frame 610 or the one or more rails 620. In an example, the actuator 660 is coupled to a positioning member 670 and to a carriage 630. The positioning member 670 can include one or more locking members 675A and 675B. The one or more locking members 675A and 675 can be screws that are threaded into the positioning member 670 and engage with (e.g., clamp) the one or more rails 620 or the frame 610. The engagement with the one or more rails 620 or the frame 610 can physically fix the positioning member 670 (and thereby the actuator 660) with respect to the frame 610 and/or the one or more rails 620. In an example, the locking members 675A and 675B can be used to fix the carriage 630 in position along the one or more rails 620.

Figure 7:
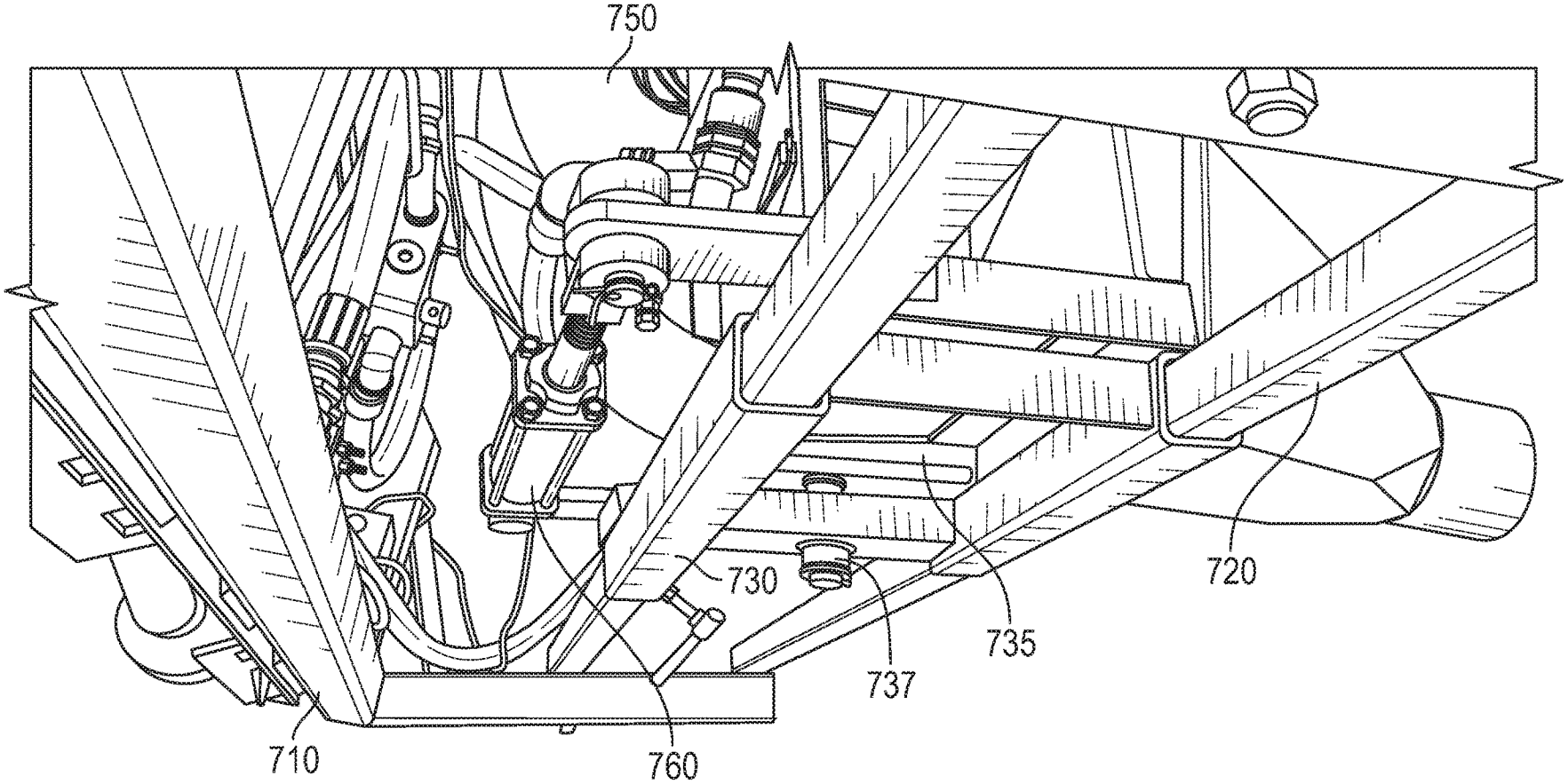
FIG. 7 is a perspective view of a bottom of a debris removal apparatus.

FIG. 7 is a perspective view of a bottom of a debris removal apparatus 700. In an example, the actuator 760 (e.g., a hydraulic cylinder) is configured to rotate the blower 750 with respect to the carriage 730. Stated another way, the blower 750 can be rotatably coupled to the carriage 730, such that the blower 750 is able to spin, or pivot, on the carriage 730. The carriage 730 can include a turntable 735 configured to allow the blower 750 to rotate with respect to the carriage 730. The carriage 730 can include a pivot point 737. The pivot point 737 can include a bearing configured to assist (e.g., allow) the rotation of the turntable 735 relative to the carriage 730. The actuator 760 can have one end coupled (e.g., affixed) to the frame 710 and an opposing end coupled to the turntable 735. The actuator 760 can have one end coupled to the one or more rails 720 and an opposing end coupled to the turntable 735. The extension and retraction of the rod 765 can cause the turntable 735 to rotate with respect to the carriage 730 (and the frame 710), and thereby cause the blower 750 to rotate with respect to the carriage 730.

The debris removal apparatus 700 can be configured to automatically translate the carriage 730 along the one or more rails 720. The debris removal apparatus 700 can be configured to automatically rotate the turntable 735 with respect to the carriage 730. Automatic translation of the carriage and automatic rotation of the turntable 735 can allow for the debris removal apparatus 700 to sweep the area surrounding the debris removal apparatus 700. Sweeping the area surrounding the debris removal apparatus 700 can include removing debris in a 180 degree arc around the front (e.g., the opposite side of the debris removal apparatus 200 from the attachment member 215 of FIG. 2) of the debris removal apparatus 700. Other angles of sweep can be used. In further examples, control of the actuator 760 and rotation of the turntable 735 may be provided with use of an electrical system of a prime mover. For instance, an electric control signal provided from the prime mover can electrically control the state of a hydraulic valve, which in turn causes the actuator 760 to extend or retract and thus rotate with respect to the carriage 730.

Figure 8:
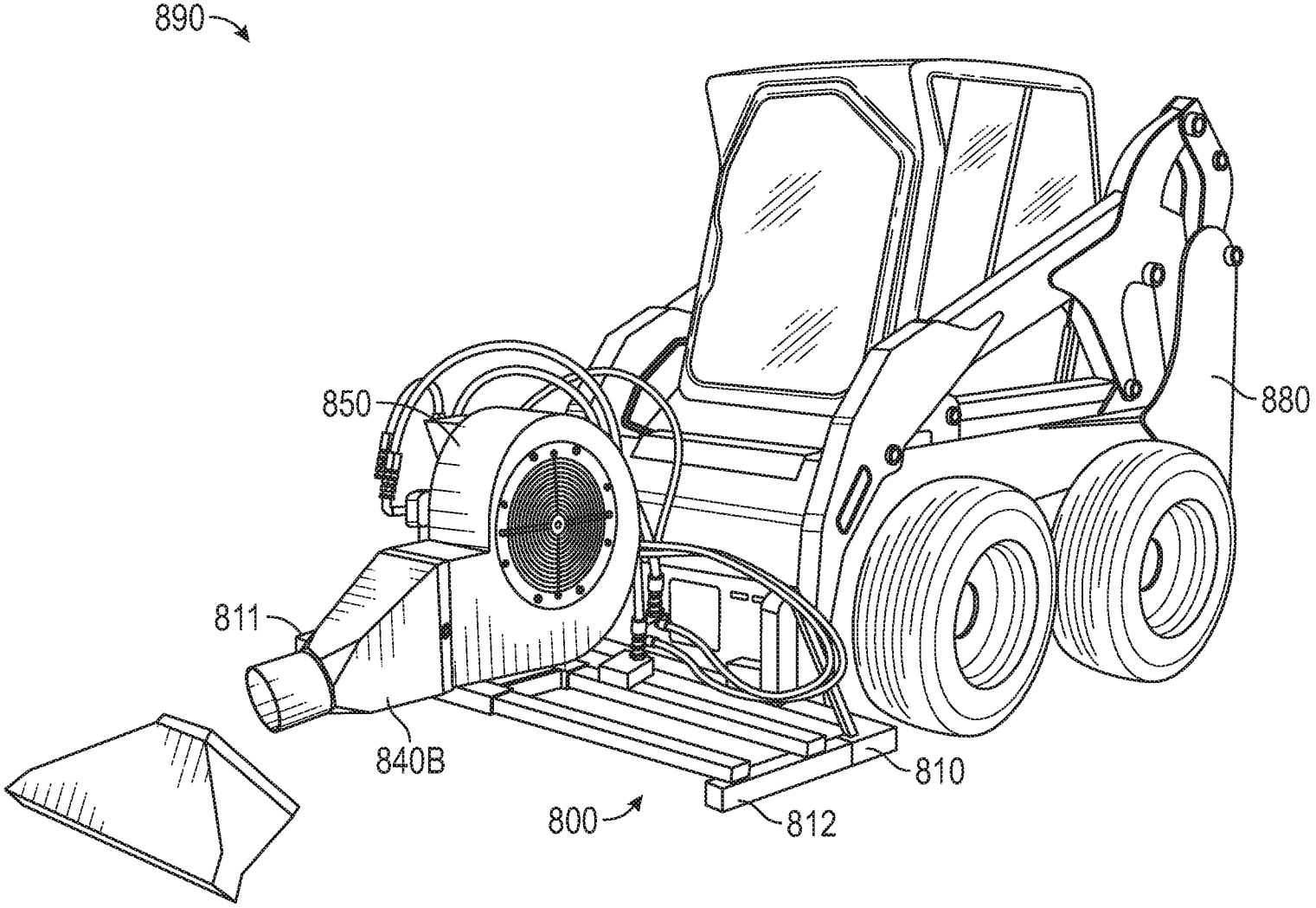
FIG. 8 is a perspective view of an example of a system for removing debris.

FIG. 8 is a perspective view of an example of a system 890 for removing debris. In an example, the system 890 includes a debris removal apparatus 800 and a prime mover 880. As previously discussed, the debris removal apparatus 800 can be configured to attach to the prime mover 880. The prime mover 880 can include one or more coupling features that are configured to mate with an attachment plate of the debris removal apparatus 800. The prime mover 880 can be a skid loader, a skid steer, a tractor, a front end loader, a truck, a telehandler, an all-terrain-vehicle, a side-by-side, a utility vehicle, a forklift, a commercial mower, or the like. The prime mover 880 can have wheels or include tracks for moving the prime mover 880.

In an example, the debris removal apparatus 800 includes a blower 850. The blower 850 can be in communication with a power system of the prime mover 880. The power system can provide energy to the blower 850 to allow the blower 850 to intake and discharge a fluid (e.g., air or water). The prime mover 880 power system can be a hydraulic system, an electrical system, a power takeoff, a pneumatic system, or an internal combustion system. The prime mover 880 can be configured to operate an actuator (e.g., the actuator 560 of FIG. 5).

As previously discussed with reference to FIGS. 1 and 5, a carriage (e.g., the carriage 530 of FIG. 5) can be configured to translate the carriage along one or more rails (e.g., the one or more rails 520 of FIG. 5). Additionally, the carriage can include a turntable (e.g., the turntable 535 of FIG. 5) configured to allow the blower 850 to rotate the blower 850 with respect to the carriage. The translation of the carriage and the rotation of the blower 850 with respect to the carriage can allow for the blower 850 to be positioned or oriented in a variety of ways with respect to the frame 810. In an example, the carriage can be translated along the one or more rails to the first side 811 of the frame 810. The turntable can be rotated, thereby rotating the blower 850), such that a second nozzle 840B coupled to the blower 850 is directed toward the first side 811 (e.g., the second nozzle 840B can be rotated 90 degrees to driver's right, toward the first side 811, such that the second nozzle 840 is facing the left side of FIG. 8).

As a non-limiting example, the prime mover 880 can be operated along a structure and blow debris from the structure, without operating the prime mover 880 on the structure. Removing debris from the structure without operating the prime mover 880 on the structure can prevent damage to the structure, ease the debris removal process, or improve the efficiency of the debris removal process. In an example, the prime mover 880 is driven on a street along a sidewalk. Positioning the carriage at the first side 811 and rotating the blower 850 as described above can allow for debris (e.g., snow, dirt, sand, grain, or the like) to be blown from the sidewalk without the prime mover 880 operating on the sidewalk. Operating the prime mover 880 on the sidewalk can damage the sidewalk because the weight of the prime mover 880 may exceed the weight that the sidewalk was engineered to withstand. Operating the prime mover away from the sidewalk can allow for the prime mover 880 to remove debris without having to avoid obstacles (e.g., planters, trees, signage, kiosks, parking meters, or the like) on the sidewalk. Avoiding obstacles on the sidewalk can reduce the amount of time required to clear the sidewalk. Operating the prime mover 880 away from the sidewalk can prevent the prime mover 880 from damaging the obstacles or other nearby structures (e.g., buildings, fences, utilities, or the like).

The debris removal system 890 can be configured to automatically translate the carriage along the one or more rails. The debris removal system 890 can be configured to automatically rotate the turntable with respect to the carriage. Automatic translation of the carriage and automatic rotation of the turntable can allow for the debris removal system 890 to sweep the area surrounding the prime mover 880. Sweeping the area surrounding the prime mover 880 can include removing debris in a 180 degree arc around the front of the prime mover 880, but is not limited to a 180 degree arc.

Various Notes & Examples

Example 1 is a debris blowing apparatus, comprising: a frame configured to attach to a prime mover, wherein the frame includes one or more rails that extend from a first side of the frame to a second side of the frame; a carriage configured to translate along the one or more rails of the frame; a blower configured to intake air and discharge the air at a blower outlet, wherein the blower is coupled with the carriage; and a nozzle configured to couple with the blower outlet.

In Example 2, the subject matter of Example 1 optionally includes a first actuator coupled with the frame and the carriage and configured to translate the carriage along the frame.

In Example 3, the subject matter of Example 2 optionally includes wherein the first actuator is repositionable along the frame.

In Example 4, the subject matter of any one or more of Examples 2-3 optionally include wherein the first actuator is configured to allow the carriage to translate from the first side of the frame to the second side of the frame.

In Example 5, the subject matter of any one or more of Examples 1-4 optionally include wherein the nozzle includes: an inlet having an opening with a first nozzle area and configured to couple with the blower outlet; and an outlet having an opening with a second nozzle area.

In Example 6, the subject matter of Example 5 optionally includes wherein the second nozzle area is less than the first nozzle area.

In Example 7, the subject matter of any one or more of Examples 5-6 optionally include wherein the second nozzle area is greater than the first nozzle area.

In Example 8, the subject matter of any one or more of Examples 1-7 optionally include wherein blower is configured to pivot on the carriage.

In Example 9, the subject matter of Example 8 optionally includes a second actuator coupled with the blower and the carriage and configured to pivot the blower with respect to the carriage.

In Example 10, the subject matter of any one or more of Examples 1-9 optionally include a cutting edge coupled to the frame and configured to translate across a blowing surface.

In Example 11, the subject matter of any one or more of Examples 1-10 optionally include wherein the debris is: snow, rocks, sand, dirt, rubbish, water, grain, or wood chips.

Example 12 is a system for blowing debris, comprising: a frame configured to attach to a prime mover, wherein the frame includes one or more rails that extend from a first side of the frame to a second side of the frame; a carriage configured to translate along the one or more rails of the frame; a blower configured to intake air and discharge the air at a blower outlet, wherein the blower is coupled with the carriage; a nozzle configured to couple with the blower outlet; and a prime mover.

In Example 13, the subject matter of Example 12 optionally includes wherein the prime mover includes a skid loader, a skid steer, a tractor, a front end loader, a truck, a telehandler, an all-terrain-vehicle, a side-by-side, utility vehicle, or a forklift.

In Example 14, the subject matter of any one or more of Examples 12-13 optionally include wherein the blower is in communication with a power system of the prime mover and the communication with the power system provides energy to intake and discharge the air.

In Example 15, the subject matter of Example 14 optionally includes wherein the power system includes a hydraulic system, an electrical system, a power takeoff, a pneumatic system, or an internal combustion system.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) may be used in combination with each other. Other embodiments can be used, such as by one of ordinary skill in the art upon reviewing the above description. The following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A debris blowing apparatus, comprising:

a frame configured to attach to a prime mover, wherein the frame includes one or more rails that extend from a first side of the frame to a second side of the frame;

a carriage configured to translate along the one or more rails of the frame;

a blower configured to intake air and discharge the air at a blower outlet, wherein the blower is coupled with the carriage, and wherein the blower is configured to pivot laterally on the carriage; and a nozzle configured to couple with the blower outlet, wherein the nozzle includes:

an inlet having an opening with a first nozzle area and configured to couple with the blower outlet; and an outlet having an opening with a second nozzle area, wherein the first nozzle area is different from the second nozzle area.

2. The apparatus of claim 1, further comprising a first actuator coupled with the frame and the carriage and configured to translate the carriage along the frame.

3. The apparatus of claim 2, wherein the first actuator is repositionable along the frame.

4. The apparatus of claim 2, wherein the first actuator is configured to allow the carriage to translate from the first side of the frame to the second side of the frame.

5. The apparatus of claim 1, wherein the second nozzle area is less than the first nozzle area.

6. The apparatus of claim 1, wherein the second nozzle area is greater than the first nozzle area.

7. The apparatus of claim 1 further comprising a second actuator coupled with the blower and the carriage and configured to pivot the blower with respect to the carriage.

8. The apparatus of claim 1, further comprising a cutting edge wheel coupled to the frame and configured to translate across a blowing surface.

9. The apparatus of claim 1, wherein the debris is: snow, rocks, sand, dirt, rubbish, water, grain, or wood chips.

10. A system for blowing debris, comprising:

a frame configured to attach to a prime mover, wherein the frame includes one or more rails that extend from a first side of the frame to a second side of the frame;

a carriage configured to translate along the one or more rails of the frame;

a blower configured to intake air and discharge the air at a blower outlet, wherein the blower is coupled with the carriage, and wherein the blower is configured to pivot laterally on the carriage;

a nozzle configured to couple with the blower outlet, wherein the nozzle includes:

an inlet having an opening with a first nozzle area and configured to couple with the blower outlet; and an outlet having an opening with a second nozzle area, wherein the first nozzle area is different from the second nozzle area; and a prime mover.

11. The system of claim 10, wherein the prime mover includes a skid loader, a skid steer, a tractor, a front end loader, a truck, a telehandler, an all-terrain-vehicle, a side-by-side, utility vehicle, or a forklift.

12. The system of claim 10, wherein the blower is in communication with a power system of the prime mover and the communication with the power system provides energy to intake and discharge the air.

13. The system of claim 12, wherein the power system includes a hydraulic system, an electrical system, a power takeoff, a pneumatic system, or an internal combustion system.

14. The system of claim 10, further comprising a cutting edge wheel coupled to the frame and configured to translate across a blowing surface.

* * * * *